United States Patent [19]

Gillham

[11] Patent Number: 4,946,207

[45] Date of Patent: Aug. 7, 1990

[54] ELECTRICALLY CONTROLLED LOCKS

[75] Inventor: Peter J. Gillham, Cranbrook, United Kingdom

[73] Assignee: Newman Tonks Security Limited, United Kingdom

[21] Appl. No.: 358,369

[22] PCT Filed: Sep. 30, 1988

[86] PCT No.: PCT/GB88/00810

§ 371 Date: May 12, 1989

§ 102(e) Date: May 12, 1989

[87] PCT Pub. No.: WO89/02967

PCT Pub. Date: Apr. 6, 1989

[30] Foreign Application Priority Data

Oct. 3, 1987 [GB] United Kingdom ..... 8723266

[51] Int. Cl.[5] ..... E05C 1/16

[52] U.S. Cl. ..... 292/173; 70/283; 292/144; 292/153; 292/359

[58] Field of Search ..... 292/173, 144, 153, 359, 292/341.16; 70/283

[56] References Cited

U.S. PATENT DOCUMENTS

| | | | |
|---|---|---|---|
| 2,466,481 | 4/1949 | Royal | 292/144 |
| 3,361,462 | 1/1968 | Foster | 292/153 X |
| 3,586,361 | 6/1971 | Ohno | 292/153 X |
| 4,529,234 | 7/1985 | Senften | 292/169 |
| 4,596,411 | 6/1986 | Geringer et al. | 292/165 |
| 4,623,178 | 11/1986 | Geringer et al. | 292/173 |

*Primary Examiner*—Richard E. Moore

*Attorney, Agent, or Firm*—Webb, Burden, Ziesenheim & Webb

[57] ABSTRACT

A lock assembly (10) for mounting on a door includes a dead-locking element (31), movement of which is controlled by an electrically operated device (35) for mounting on the door frame and magnetically coupled to a linkage system (32,33) whereby the dead-locking element (31) is moved. The linkage system carries a permanent magnet (34) which interacts with the core (37) of the solenoid when the door is in its closed position, and when the solenoid is energised it repels the permanent magnet (34) thereby operating the linkage system to move the dead-locking element (31) away from its operative position, thereby allowing a locking member (12) to be withdrawn.

9 Claims, 1 Drawing Sheet

ELECTRICALLY CONTROLLED LOCKS

DESCRIPTION OF INVENTION

This invention relates to electrically controlled locks of the type in which a deadlocking element which forms part of the locking mechanism is movable by means of an electrically operated control device between an operative position in which the lock mechanism is dead-locked and an inoperative position in which the lock mechanism is freed to enable a latch or bolt element to be withdrawn. Such locks are hereinafter referred to as electrically controlled locks of the kind specified.

Conventionally, electrically controlled locks of the kind specified incorporate a solenoid within the lock housing which is mounted on or in a door, so that it is necessary to provide electric wiring on or in the door and a flexible conductor or conducting hinge connected to the external wiring. This is undesirable for a number of reasons, including difficulty of installation, reliability and safety.

One way of avoiding this requirement is by providing the electrically operated control device on the door frame in assocation with a keep in which the latch or bolt element is received instead of on the door in association with the locking mechanism which controls the bolt or latch element.

However, this has the disadvantage that the door frame and keep have to be constructed in such a way as to allow the door to be opened whilst the latch or bolt element remains in its projected position, thus introducing an inherent weakness into the system, which is then not suitable for high security applications.

In accordance with the present invention, in an electrically controlled lock of the kind specified the dead-locking element is coupled to the electrically operated control device magnetically so that said control device can be installed in the door frame, thereby obviating the need for electrical wiring in or on the door itself.

In a preferred arrangement the dead-locking element is connected to a linkage system which includes a permanent magnet disposed at an edge of the lock housing which, in use, will register with an edge of the associated door frame, and the electrically operated control device includes a solenoid for mounting within the door frame in register with said permanent magnet.

Figure 1:
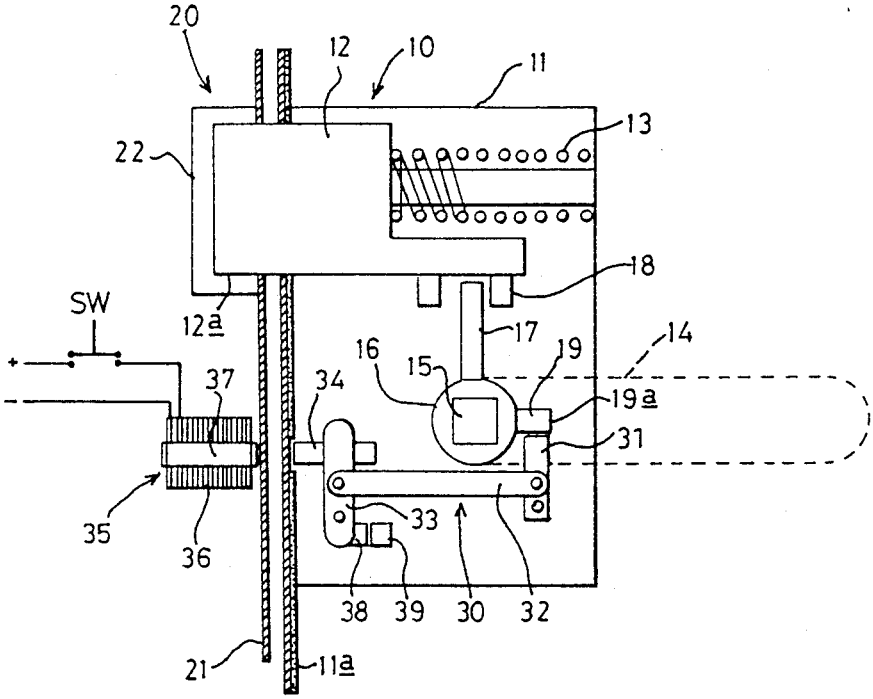
Figure 2:
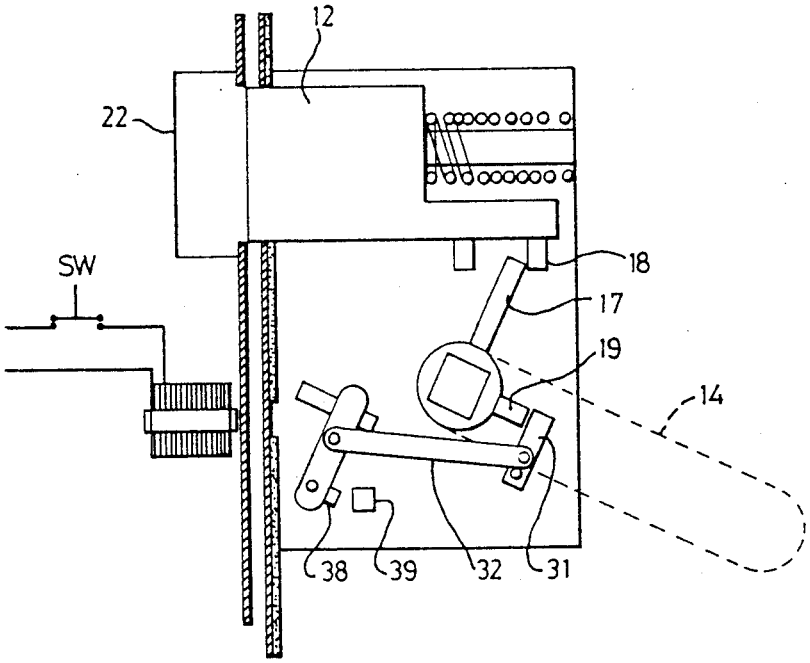

The invention will now be described by way of example with reference to one embodiment thereof as schematically illustrated in the accompanying drawings wherein:

FIGS. 1 and 2 respectively illustrate a lock and keep combination in its locked condition and in its unlocked condition.

In the illustrated embodiment a lock assembly 10 is adapted in conventional manner to be mounted within the thickness of a door (not shown) and an associated keep assembly 20 is likewise adapted to be mounted in a door frame (not shown).

The lock assembly 10 comprises a generally conventional housing 11 with a face plate 11*a* which is adapted to be mounted at the outer edge of a hinged door. The housing 11 contains a latch 12 which is biased outwardly by means of an associated spring 13, and the latch 12 can be withdrawn manually by means of a lever handle 14 mounted on a square section spindle 15 which carries a collar 16 having an arm 17 arranged to engage an abutment 18 provided on the latch 12 whereby operation of the lever handle 14 withdraws the latch 12 against the force of spring 13 in conventional manner.

The keep assembly 20 includes a mounting plate 21 and a recess 22 for the reception of the protruding end portion 12*a* of the latch 12, the mounting plate 21 being adpated for mounting on an edge face of a door frame in register with the face plate 11*a* of the lock assembly 10.

Thus far, the lock and keep assembly are entirely conventional, and it will be understood that the lock assembly 10 may also include any conventional key-operated locking mechanism for dead-locking the bolt 12 or a separate dead-bolt if required.

The lock assembly 10 in accordance with the invention also incorporates an electrically controlled dead-lock mechamism 30 which comprises a pivotally mounted dead-locking element 31 which is movable into a position (as shown in FIG. 1) in register with an abutment 19 provided on the collar 16 so as to prevent rotation of the collar in the direction required to withdraw the latch 12 from the recess 22.

In accordance with the invention the dead-locking element 31 is movable by means of an electrically operated control device 35 provided on the keep assembly 20 as shown, or alternatively on a separate assembly adjacent thereto.

The pivoted dead-locking element 31 is connected by means of a transverse link 32 to a pivoted lever 33 which carries a strong permanent magnet 34 adjacent to the face plate 11*a*, which is made of a non-magnetic material. The control device 35 comprises a solenoid 36 with a soft iron core 37 arranged (when the door is closed) in alignment with one end of the permanent magnet 34 as shown in FIG. 1.

Preferably, both the face plate 11*a* and the mounting plate 21 are made from a material which transmits magnetic flux efficiently so that it is not necessary to form apertures therein for this purpose.

Normally, the solenoid 36 is not energised and the magnet 34 is attracted to the soft iron core 37. However, since the spacing between the magnet 34 and the core 37 may vary in different installations, so that the attraction of the magnet towards the core may not always be sufficient to hold the linkage relaibly in the position shown in FIG. 1, the lever 33 also carries a further permanent magnet 38 which is attracted towards a fixed steel post 39 whereby the linkage system is returned to, and maintained in, the position illustrated in FIG. 1 after the door has been opened, as hereinafter described, and after the lever handle 14 has been released. Alternatively, the magnet 38 could be attached to the dead-locking element 31 or another part of the linkage system for inter-action with a suitably positioned steel post. In a further embodiment, the magnet 38 could be replaced by a fixed permanent magnet which interacts with a magnetiseable component carried on or afforded by part of the linkage system.

To enable the door to be opened, the dead-locking element 31 is moved to the position illustrated in FIG. 2, and for this purpose the solenoid 36 is energised by any appropriate electrical device. For example, a key-pad which requires a predetermined code number to be entered, a magnetic card reader or a manually operable switch at a remote location, all represented diagrammatically as a switch Sw in the drawings.

Energisation of the solenoid temporarily magnetises the soft iron core 37 and using an appropriately polarised DC supply the end of the core 37 facing the edge of the door presents the same polarity as the adjacent end of the magnet 34, e.g. north-to-north or south-to-south, and magnetic flux therefrom bridges the air gap between the door frame and the door edge so that the permanent magnet 34 interacts with the core 37. When the solenoid 36 is energised as described, the permanent magnet 34 will be repelled with the result that the lever 33 pivots away from the face plate 11*a*, causing the dead-locking element 31 to pivot away from the abutment 19, thereby freeing the collar 16 to enable the lever handle 14 to be turned to withdraw the latch 12.

It will be understood that the repulsive force generated between the core 37 and magnet 34 must be sufficient to overcome the attractive force between the magnet 38 and the adjacent post 39, but this can readily be achieved by selection of the relative strength of the magnets and the leverage obtained due to the spacings of the magnets 34 and 38 from the pivot point of the lever 33.

It will also be appreciated that whilst the lever handle 14 is depressed, the end face 19*a* of the abutment 19 will hold the dead-locking element 31 in its displaced position, as shown in FIG. 2. However, once the lever handle 14 is released, the dead-locking element 31 is free to return to its operative position as illustrated in FIG. 1. This is achieved, at least in part, by the attraction of the magnet 38 towards the post 39, but spring or other bias may additionally or alternatively be applied to the dead-locking mechanism 30, so that the magnet 34 will always be returned to a position close to the face plate 11*a* where it will interact with the core 37 of the solenoid 36 when the door is shut.

Whilst in the embodiment described, the lock assembly includes a latch 12, it will be appreciated that the latter may be replaced by a bolt, or that a separate bolt with an associated key-operable mechanism may be provided.

Also, whilst the permanent magnet 34 is repelled by the soft iron core 37 in the illustrated embodiment to move the dead-locking element 31 into its inoperative position, in some arrangements it may be appropriate for the permanent magnet to be attracted towards the core for this purpose.

Moreover, whilst the solenoid is normally de-energised to allow the dead-locking element 31 to remain in its inoperative when the door is shut, it would alternatively be possible for a solenoid to be energised with opposite polarity so as to attract the permanent magnet until such time as the door is to be opened. For this purpose, the switch Sw could be a changeover switch instead of a make and break switch. It will further be appreciated that the switch Sw as illustrated need not be a simple switch, but could be afforded by the contacts of a relay or by an appropriate solid state device.

The dead-locking mechanism 30 may operate to lock the handle 14 on one side only of the door so that for normal eixt or emergency escape purposes the lock can always be released manually from the other side by the operation of the handle which is not coupled to the lever handle 14.

The invention can be applied to any conventional form of door lock by the provision of a dead-locking element which is movable into a position such as to hold a bolt or latch element against withdrawal from its projected position; the dead-locking element being movable in a consequence of magnetic force exerted on a permanent magnet which is movably mounted within the lock assembly, the required magnetic force being derived from a control device mounted in or adjacent to the keep assembly in the door frame. Whilst such control device is most conveniently in the form of an electro-magnet, it will be appreciated that it may also take the form of a mechanically movable permanent magnet which is displaceable into such a position as to interact with the permanent magnet in the lock assembly in the required manner.

I claim:

1. An electrically controlled lock and keep assembly (10,20) comprising a locking member (12) which is movable between a locking position in which it projects from the lock assembly (10) and can engage in the keep assembly (20) and a releasing position in which it is substantially withdrawn, a locking mechanism (30) including a dead-locking element (31) movable between an operative position in which the locking mechamism is dead-locked to hold the locking member in its locking position and an inoperative position in which the locking mechanism is freed to enable the locking member (12) to be withdrawn, and an electrically operated control device (35) for controlling movement of said dead-locking element (31) at least from its operative position to its inoperative position, characterized in that said control device (35) is associated with the keep assembly (20) and is operatively interconnected with the dead-locking element (31) through a magnetic coupling means (37,34), wherein said magnetic coupling means comprises a first magnetic element (37) associated with the keep assembly (20) and a second magnetic element (34) associated with the lock assembly (10), said first and second magnetic elements being coupled by a magnetic flux extending between said keep assembly (20) and said lock assembly (10).

2. An assembly according to claim 1 wherein the dead-locking element (31) is connected to a linkage system (32,33) and the second magnetic element includes a permanent magnet (34) which is connected by said linkage system to the dead-locking element (31).

3. An assembly according to claim 2 wherein the first magnetic element comprises a solenoid (36) which forms part of the control device (35).

4. An assembly according to claim 3 wherein the solenoid incorporates a magnetiseable core (37).

5. An assembly according to claim 3 or claim 4 wherein control means (Sw) are provided for selectively energising said solenoid (36) to produce a magnetic field which acts on said permanent magnet (34) to move the latter in the direction required to move the dead-locking element (31) from its operative position to its inoperative position.

6. An assembly according to claim 5 wherein a further permanent magnet (38) is arranged to move the dead-locking element (31) from its inoperative position to its operative position.

7. An assembly to claim 6 wherein said permanent magnet (34) and said further magnet (38) are both carried by a lever (33) part of said linkage system.

8. A door and frame assembly fitted with an electrically controlled lock and keep assembly (10,20) comprising a locking member (12) which is movable between a locking position in which it projects from the lock assembly (10) and can engage in the keep assembly (20) and a releasing position in which it is substantially withdrawn, a locking mechanism (30) including a dead-locking element (31) movable between an operative position in which the locking mechanism is dead-locked to hold the locking member in its locking position and an inoperative position in which the locking mechanism is freed to enable the locking member (12) to be withdrawn, and an electrically operated control device (35) for controlling movement of said dead-locking element (31) at least from its operative position to its inoperative position, characterized in that said control device (35) as associated with the keep assembly (20) mounted in the door frame and is operatively connected to the dead-locking element (31) in the lock assembly (10) mounted on the door through magnetic coupling means (37,34), wherein said magnetic coupling means comprises a first magnetic element (37) associated with the keep assembly (20) and a second magnetic element (34) associated with the lock assembly (10), said first and second magnetic elements being coupled by a magnetic flux extending between said keep assembly (20) and said lock assembly (10).

9. A door and frame assembly according to claim 8 wherein the magnetic coupling means comprises a solenoid (36) mounted in the frame and a permanent magnet (34) in the lock assembly (10) on the door.

* * * * *

UNITED STATES PATENT AND TRADEMARK OFFICE

CERTIFICATE OF CORRECTION

PATENT NO. : 4,946,207

DATED : August 7, 1990

INVENTOR(S) : Peter J. Gillham

It is certified that error appears in the above-identified patent and that said Letters Patent is hereby corrected as shown below:

Column 2 Line 15 "mechamism" should read --mechanism--.

Column 2 Line 43 "relaibly" should read --reliably--.

Column 3 Line 45 after "inoperative" insert --position--.

Claim 1 Line 16 Column 4 "mechamism" should read --mechanism--.

Claim 7 Line 57 Column 4 after "(33)" insert --forming--.

Signed and Sealed this

Seventeenth Day of December, 1991

*Attest:*

HARRY F. MANBECK, JR.

*Attesting Officer*

*Commissioner of Patents and Trademarks*